US007920778B2

(12) United States Patent
Quah et al.

(10) Patent No.: US 7,920,778 B2
(45) Date of Patent: Apr. 5, 2011

(54) BOILER FOR USE IN A STEAM GENERATING DEVICE

(75) Inventors: Peng Chau Quah, Hoogeveen (NL); Barry Eng Keong Tay, Singapore (SG); Tamilselvan Thirumazhisai Sankaralingam, Singapore (SG); Ajit Pal Singh, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 956 days.

(21) Appl. No.: 11/722,475

(22) PCT Filed: Dec. 19, 2005

(86) PCT No.: PCT/IB2005/054300

§ 371 (c)(1), (2), (4) Date: Jun. 21, 2007

(87) PCT Pub. No.: WO2006/067722

PCT Pub. Date: Jun. 29, 2006

(65) Prior Publication Data

US 2010/0014845 A1 Jan. 21, 2010

(30) Foreign Application Priority Data

Dec. 22, 2004 (EP) ..... 04106871

(51) Int. Cl.
*F22B 1/28* (2006.01)

(52) U.S. Cl. ..... 392/401; 392/394

(58) Field of Classification Search ..... None
See application file for complete search history.

(56) References Cited

U.S. PATENT DOCUMENTS

| | | | |
|---|---|---|---|
| 5,881,207 | A | 3/1999 | DeBourg |
| 2004/0040185 | A1 | 3/2004 | Morgandi |

FOREIGN PATENT DOCUMENTS

| | | |
|---|---|---|
| DE | 3941322 | 6/1991 |
| DE | 4304532 | 8/1994 |
| EP | 0438112 | 7/1991 |
| EP | 0 855 555 | 7/1998 |
| EP | 1619291 | 1/2006 |
| NL | 9500322 | 10/1996 |

*Primary Examiner* — Thor S Campbell

(57) ABSTRACT

A boiler (1) for heating water to steam comprises a boiler housing (10) having a bottom wall (12), a top wall (13) and a circumferential wall (14) extending between these walls (12, 13). When the boiler (1) is mounted in a steam generating device for generating steam and supplying steam to an appliance such as a steam iron (20), the boiler (1) is given an inclined orientation. In a lower portion (13*a*) of the top wall (13) of the boiler housing (10), an inlet opening (15) for letting in water to a boiler space (11) which is enclosed by the boiler housing (10) is arranged. When water is supplied through the inlet opening (15), the water lands on a lower zone (14*a*) of the circumferential wall (14) and flows further in a downward direction, along the circumferential wall (14). As a result, the water is pre-heated when it reaches the water which is already present in the boiler space (11), and there is no danger of the steam production getting interrupted.

16 Claims, 3 Drawing Sheets

BOILER FOR USE IN A STEAM GENERATING DEVICE

The present invention relates to a boiler for heating water, comprising a boiler housing enclosing a boiler space, wherein an inlet opening for letting in water to the boiler space is arranged in the boiler housing.

Such a boiler is commonly known, and is applied in various types of personal devices, including steam ironing devices, active ironing boards capable of supplying steam to objects to be ironed, facial sauna devices, steam cleaning devices and coffee makers.

EP 0 855 555 discloses a boiler which is suitable to be used in combination with an iron, and which is located on a moving member which oscillates about a horizontal hinging axis and is supported by a spring. When steam is produced and the quantity of water inside the boiler is reduced, the moving member is gradually raised by the spring until raising of the moving member is such that it triggers, via a microswitch, operation of an electric pump so as to allow a desired and limited quantity of cold water to be introduced to the boiler. In the process, the quantity of pumped water is limited with respect to the residual quantity of water which is already boiling, so that there is practically no variation in the capacity of the boiler to deliver steam.

U.S. Pat. No. 5,881,207 discloses a steam generator with automatic supply, which has a level sensor arranged in a zone of a vessel located at a set threshold level. During operation of the steam generator, the sensor measures the temperature and compares it with a reference temperature, in order to establish whether a liquid reaches the threshold level. Furthermore, the steam generator has an adjustment means acting in relation to the steam tapping operations, so that the sensor temperature varies in relation to the level of liquid over a variation range enabling comparison with a reference temperature, wherein the reference temperature remains within the variation range. In this way, usable signals are provided, notably when the liquid is boiling and not only when there is a stable equilibrium between liquid and gas.

EP 0 438 112 discloses a steam iron which has a button for activating an electric valve for delivering steam generated by a separate boiler which has a pressure switch and thermostats. A refillable water tank is connected to at least one pump which is connected to the boiler by means of a non-return and/or self-triggering valve. A temperature sensor and/or a sensor for detecting the weight of the boiler is provided for activating the pump. The boiler may have at least one level switch. This device allows to provide a low-capacity boiler and at the same time allows a continuous and constant delivery of steam.

EP 0 821 096 discloses a steam generating device which comprises a boiler, a water tank and a water supply pipe which connects the water tank to the boiler and which has inserted inside it a delivery pump. The boiler has an inclined bottom onto which a heating plate is externally mounted. In a practical embodiment, the heating plate is associated in a close-fitting manner with the bottom by means of bolting with the application, in between, of a thermally conductive paste.

For the purpose of controlling a supply of water when a water level inside the boiler falls below a predetermined minimum value, the steam generating device comprises a thermostatic switch, which is capable of actuating the delivery pump, and which is arranged in a top zone of the inclined bottom of the boiler. A hole via which the water enters the boiler is arranged in the region of the zone where the thermostatic switch is mounted.

In the known steam generating device, when the water level inside the boiler is below the predetermined minimum value, the top zone of the bottom of the boiler is no longer covered with water. Characteristics of a thermal behaviour of the top zone are strongly dependent of whether water is present above the top zone, or not. The thermostatic switch is adapted to activating the pump when an interpretation of sensed characteristics of the thermal behaviour of the top zone points out that the level of the water inside the boiler has fallen below the level of the top zone of the bottom of the boiler.

As a result of the inclined configuration of the bottom of the boiler, it is ensured that the boiler always contains a quantity of water, so that the steam production is not subject to interruptions, even if the water level should fall below the predetermined minimum level.

A disadvantage of the steam generating device known from EP 0 821 096 is that the hole for letting in water needs to be positioned in the region of the top zone of the bottom of the boiler, and that the position of the hole may not be chosen freely. For example, the hole may not be positioned such as to provide access for a flow of water to a lower zone of the bottom of the boiler, because in such a case, a relatively small quantity of heated water which is present in the lower zone would immediately get mixed with newly supplied, cold water, which would cause an interruption of the steam production. In order to avoid such a disadvantageous situation, it is necessary to ensure that newly supplied water lands on the top zone of the bottom of the boiler, so that an as large as possible portion of the bottom of the boiler may be used for pre-heating newly supplied water before it mixes with water which is already present in the boiler.

The present invention proposes modifications of the design of the boiler, wherein it is not necessary for the position of the hole for letting in water to be above the top zone of the bottom of the boiler in order to ensure a continuous steam production.

According to a first solution offered by the present invention, a boiler for heating water is provided, comprising a boiler housing enclosing a boiler space, wherein an inlet opening for letting in water to the boiler space is arranged in the boiler housing, providing access for a flow of water to a portion of a wall of the boiler housing, other than a portion of a wall situated at a bottom side of the boiler, and wherein, during operation of the boiler, the first-mentioned portion of the wall of the boiler housing is involved in a process of heating water entering the boiler space before this water mixes with water which is already present in the boiler space.

In a boiler as mentioned in the preceding paragraph, the wall of the boiler housing, which is hot during operation of the boiler, is involved in the process of heating water entering the boiler space before this water mixes with water which is already present in the boiler space. In this way, it is possible to have a surface which is large enough for heating newly supplied water to such an extent that the steam production is not interrupted when this water mixes with the water which is already present in the boiler space, even if the available surface of a wall situated at the bottom side of the boiler is only partially used, or not used at all.

In general, the first solution offered by the present invention boils down to using another portion of the boiler housing than the wall situated at the bottom side of the boiler for the purpose of heating the water, in addition to using this wall, or in stead of using this wall. In many practical cases, heating means for generating heat are only provided at an outside of the wall situated at the bottom side of the boiler, but even in such cases, it is still possible to use a portion of another wall for heating the water, because the other walls are heated through contact with the wall situated at the bottom side of the boiler, as well as through contact with the steam that is generated inside the boiler.

Besides the advantage of allowing for various positions of the inlet opening, the first solution offers the advantage of avoiding a phenomenon called intermittent pumping when the boiler according to the present invention is applied in a steam generating device. In the steam generating device known from EP 0 821 096, when the water level in the boiler has fallen below the predetermined minimum value and the pump is activated by the thermostatic switch, water is supplied to the boiler and lands on the top zone of the inclined bottom of the boiler and flows in the direction of the lower zone of the bottom. As a result of the water landing on the top zone of the bottom, the temperature of this zone drops rapidly. As soon as the thermostatic switch senses the temperature drop, it deactivates the pump, even though the total quantity of water in the boiler is not sufficient to cover the top zone of the bottom. Soon after the pump is de-activated, the temperature of the uncovered top zone of the bottom increases rapidly, and the thermostatic switch activates the pump again. This cycle is repeated until the water level has reached a predetermined value at which the top zone of the bottom is covered.

In the boiler according to the present invention, newly supplied water is heated under the influence of contact with another wall of the boiler housing before it reaches the wall situated at the bottom side of the boiler. In this way, it is achieved that intermittent pumping occurs to a lesser extent or does not even occur at all. A further advantage is that thermo-shock effects to heating means of the boiler are reduced, whereby the reliability and durability of these means are improved.

The wall of the boiler housing may be provided with projecting plates or the like, which are positioned in a path to be followed by a flow of fresh water. Within the scope of the present invention, such projecting plates or similar means are also considered as a portion of wall of the boiler housing, other than a portion of a wall situated at a bottom side of the boiler.

The heating means of the boiler are connected to an outside of the boiler housing. Preferably, the connection between the heating means and the boiler housing is established by means of a connecting method involving melting together of materials under the influence of heat, such as brazing, soldering or welding, as in this way, it is achieved that heat transfer from the heating means to the water, through the boiler housing, takes place in a very efficient manner. In particular, in a situation in which the heating means are directly connected to the boiler housing by means of a connecting method such as brazing, soldering or welding, an inter-metallic layer is formed between the heating means and the boiler housing, and the transfer of heat takes place in a more efficient manner than in a situation in which the heating means are mounted on the boiler housing by means of screws or similar fastening means.

In a preferred embodiment of the boiler, the heating means comprise a heating element for generating heat and a heating plate for distributing heat, wherein the heating plate is connected to the outside of the boiler housing by means of a connecting method involving melting together of materials under the influence of heat, such as brazing, soldering or welding, and wherein the heating element is connected to the heating plate by means of a similar connecting method.

In another preferred embodiment, the boiler housing comprises a bottom wall, a top wall and a circumferential wall extending between the bottom wall and the top wall, wherein the bottom wall is situated at a bottom side of the boiler and the top wall is situated at a top side of the boiler, and wherein the inlet opening for letting in water to the boiler space is arranged for providing access for a flow of water to a portion of the circumferential wall. In case an orientation of a longitudinal axis of the boiler deviates from the vertical, the inlet opening may simply be provided in the top wall of the boiler housing and, at the same time, provide access for a flow of water to a portion of the circumferential wall. Advantageously, the circumferential wall comprises a lower zone and an upper zone, and the inlet opening is arranged for providing access for a flow of water to the upper zone of the circumferential wall. In such a case, it is possible that a relatively large surface of the boiler housing applied for heating newly supplied water is obtained.

Within the scope of the present invention, it is also possible that the inlet opening is arranged for providing access for a flow of water to the top wall of the boiler housing. In such a case, newly supplied water may flow along a portion of the top wall and the circumferential wall before it reaches the bottom wall or the water which is already present in the boiler space.

Advantageously, the top wall of the boiler housing comprises a lower portion and an upper portion, wherein the upper portion is arranged at a higher level than the lower portion, and wherein the inlet opening is arranged in the lower portion of the top wall. In practice, in such an embodiment, the top wall may comprise a planar sheet, which has an inclined orientation with respect to the horizontal. An advantage of arranging the inlet opening in the lower portion of the top wall in stead of the upper portion of the top wall is that an overall height of the boiler and connecting means for connecting a water supply hose to the boiler may be reduced. This is especially advantageous in case the boiler is used in an appliance offering limited space, for example a hand-held steam iron.

The bottom wall of the boiler housing may also comprise a lower portion and an upper portion, wherein the upper portion is arranged at a higher level than the lower portion. In practice, in such an embodiment, the bottom wall may comprise a planar sheet, which has an inclined orientation with respect to the horizontal. In this way, it is achieved that the area of the bottom wall is increased with respect to a bottom wall having a horizontal orientation and having the same horizontal dimensions. Consequently, a heating plate or the like covering an outside of the bottom wall may be larger. Furthermore, due to the inclined orientation of the bottom wall, it is possible to have a situation in which only the lower portion is covered with water, while the upper portion is uncovered. As it is relatively easy to detect such a situation, controlling of a water level in a boiler having an inclined bottom wall is relatively easy. Another advantage of the inclined orientation of the bottom wall is that a buffer quantity of water is present in the boiler, so that interruptions of the steam production may be prevented.

According to a second solution offered by the present invention, a boiler for heating water is provided, comprising a boiler housing enclosing a boiler space, and heating means for heating a content of the boiler housing, which are connected to an outside of the boiler housing by means of a connecting method involving melting together of materials under the influence of heat, such as brazing, soldering or welding. In such a boiler, in comparison with a boiler comprising heating means which are mounted on the boiler housing by means of screws or similar fastening means, the efficiency of the transfer of heat from the heating means to the water which is present in the boiler space, through the walls of the boiler housing, is improved. In this way, it is possible to use a smaller surface for heating newly supplied water to such an extent that the steam production is not interrupted when this water mixes with the water which is already present in the boiler space. Consequently, in positioning the inlet opening, it is not necessary to take into account a requirement of obtaining a large as possible surface for heating the water. In case of the boiler housing having an inclined bottom wall, this implies that the inlet opening does not necessarily need to provide access for a flow of water to an upper portion of the bottom wall.

NL 9 500 322 discloses a boiler as mentioned in the preceding paragraph. In particular, the boiler known from NL 9 500 322 has a coil-shaped resistance heating element which is connected to a bottom of the boiler housing by welding.

According to the second solution offered by the present invention, the heating means comprise both a heating element for generating heat and a heating plate for distributing heat, wherein the heating plate is connected to the outside of the boiler housing by means of a connecting method involving melting together of materials under the influence of heat, such as brazing, soldering or welding, and wherein the heating element is connected to the heating plate by means of a similar connecting method.

The present invention also relates to a steam generating device, comprising a water tank for containing water, a boiler according to the present invention, and supplying means for supplying water from the water tank to the boiler space of the boiler, through the inlet opening arranged in the boiler housing of the boiler, comprising a pump. Furthermore, the present invention relates to a domestic appliance comprising the boiler according to the present invention, wherein the domestic appliance may for example be a steam ironing device, an active ironing board, a facial sauna device, a steam cleaning device or a coffee maker.

The present invention will now be explained in greater detail with reference to the Figures, in which similar parts are indicated by the same reference signs, and in which:

FIG. 1 diagrammatically shows a steam ironing device comprising a boiler according to a first preferred embodiment of the present invention;

FIG. 2 diagrammatically shows a steam ironing device comprising a boiler according to a second preferred embodiment of the present invention;

Figure 1:
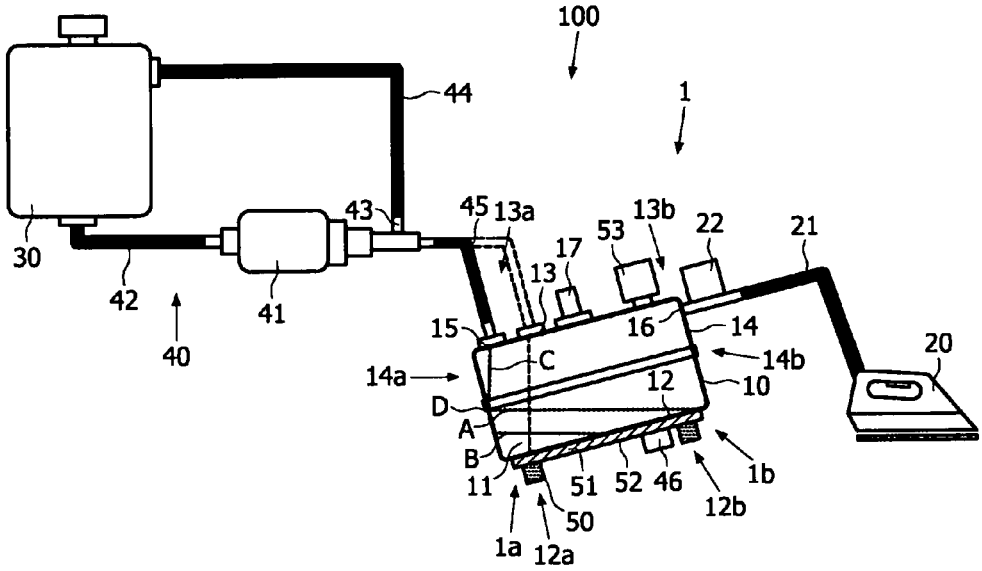

FIG. 1 diagrammatically shows a steam ironing device 100, comprising a boiler 1 according to a first preferred embodiment of the present invention, which will hereinafter also be referred to as first boiler 1. A main function of the boiler 1 is heating water to steam. Normally, the boiler 1 is mounted in a plastic housing (not shown).

The boiler 1 comprises a boiler housing 10 enclosing a boiler space 11 where, during operation of the boiler 1, a process of converting water into steam takes place. The boiler housing 10 is preferably made of stainless steel, and is shaped like a cylinder, comprising a bottom wall 12 and a top wall 13. In the shown example, both the bottom wall 12 and the top wall 13 comprise a planar sheet. Furthermore, the boiler housing 10 comprises a circumferential wall 14 extending between the bottom wall 12 and the top wall 13. In a preferred embodiment of the boiler 1, the circumferential wall 14 has a circular circumference, but that does not alter the fact that the circumferential wall 14 may be shaped differently.

In the shown example, the bottom wall 12 and the top wall 13 of the boiler housing 10 extend substantially parallel with respect to each other. A central axis of the circumferential wall 14 extends substantially perpendicular with respect to both the bottom wall 12 and the top wall 13, and a diameter of the circumferential wall 14 is constant over its height. The boiler housing 10 may comprise an upper formed shell and a lower formed shell, which are connected to each other by means of a suitable connecting method, for example by means of welding.

The boiler 1 is oriented such that the bottom wall 12 and the top wall 13 of the boiler housing 10 are inclined with respect to the horizontal. As a consequence of this orientation, it is possible to discern a lower portion 12*a*, 13*a* and an upper portion 12*b*, 13*b* in both the bottom wall 12 and the top wall 13, to discern a lower zone 14*a* and an upper zone 14*b* in the circumferential wall 14, and to discern a lower region 1*a* and an upper region 1*b* in the boiler 1.

For the purpose of letting in water to the boiler space 11, an inlet opening 15 is arranged in the lower portion 13*a* of the top wall 13. For the purpose of letting out steam from the boiler space 11, an outlet opening 16 is arranged in the upper zone 14*b* of the circumferential wall 14, near a location where the circumferential wall 14 is connected to the top wall 13.

The steam ironing device 100 comprises a steam iron 20. The design and the operation of the steam iron 20 will not be explained here, as steam irons are generally known, and the present invention does not relate to the steam iron 20 as such. The steam iron 20 is connected to the outlet opening 16 of the boiler 1, through a steam delivery hose 21, on which an electro-valve 22 for steam release is arranged.

The steam ironing device 100 further comprises a water tank 30 for containing water and a supplying arrangement 40 for supplying water from the water tank 30 to the boiler space 11 of the boiler 1, through the inlet opening 15 of the boiler 1. The supplying arrangement 40 comprises an electrical water pump 41 for pumping water from the water tank 30 to the boiler 1. At an inlet side, the pump 41 is connected to the water tank 30, through a pump hose 42. At an outlet side, the pump 41 is connected to a de-airing valve 43. By means of this valve 43, a situation in which the boiler 1 gets overfilled with water when vacuum is formed in the boiler space 11 as a result of the boiler 1 cooling down after use is avoided. The de-airing valve 43 is connected to the water tank 30, through a de-airing hose 44. Furthermore, at the outlet side, the pump 41 is connected to the inlet opening 15 of the boiler 1, through a water supply hose 45.

For the purpose of heating water which is present in the boiler space 11, the boiler 1 comprises a ring-shaped or U-shaped heating element 50 and a heating plate 51 for distributing heat which is generated by the heating element 50 during its operation. Preferably, a material of which the heating element 50 is made comprises metal, and the same applies to a material of which the heating plate 51 is made.

The heating plate 51 covers a major portion of an outer surface of the bottom wall 12 of the boiler housing 10, and is connected to the bottom wall 12 by means of a connecting method involving melting together of metal materials under the influence of heat, such as brazing, soldering or welding. In this way, an inter-metallic layer is formed between the heating plate 51 and the bottom wall 12, causing a transfer of heat from the heating plate 51 to the bottom wall 12 during operation of the heating element 50 to be very efficient. The heating element 50 is arranged on a lower surface 52 of the heating plate 51, wherein a connection between the heating element 50 and the heating plate 51 is established in the same manner as the connection between the heating plate 51 and the bottom wall 12, or by casting. Consequently, the heating element 50 and the heating plate 51 are also connected to each other by an inter-metallic layer, and the heat transfer from the heating element 50 to the heating plate 51 during operation of the heating element 50 is also very efficient.

It is noted that it is possible to apply a connection method such as stud welding for the purpose of establishing a connection between the heating plate 51 and the boiler housing 10, and between the heating element 50 and the heating plate 51. Furthermore, it is also possible to realize a very efficient heat transfer when at least one of the connection between the heating plate 51 and the boiler housing 10 and the connection between the heating element 50 and the heating plate 50 is established in another way than by means of a connecting method involving melting together of materials under the influence of heat. For example, the connection may be established by applying a heat-resistant glue. It is important that the heating means 50, 51 of the boiler 1 are somehow directly connected to the boiler housing 10 and directly connected to each other.

On the top wall 13 of the boiler housing 10, a safety valve 17 and a pressostat 53 are arranged. The pressostat 53 serves for controlling the operation of the heating element 50 on the basis of a requirement that a predetermined pressure needs to be maintained in the boiler space 11, wherein the predetermined pressure is related to the presence of a predetermined quantity of steam in the boiler space 11. When the pressure appears to be lower than the predetermined pressure, the heating element 50 is switched on, and when the pressure appears to be equal to or higher than the predetermined pressure, the heating element 50 is switched off.

During operation of the steam ironing device 100, water which is present in the boiler space 11 is converted to steam, and the steam is supplied to the steam iron 20. In order to ensure a continuous steam production, and in order to avoid a situation of the boiler 1 boiling dry, it is important that the boiler 1 is equipped with means for controlling a water level inside the boiler 1, wherein these means are adapted to activating the pump 41 when the water level is below a predetermined minimum, and to stopping the pump 41 when the water level is at a predetermined maximum. In particular, these means comprise a thermostatic switch 46, which is arranged on the lower surface 52 of the heating plate 51, in the upper region 1*b* of the boiler 1.

The thermostatic switch 46 comprises a sensing component for sensing the temperature and a switching component which is controlled on the basis of the outcome of temperature measurements performed by the sensing component. It is possible that these components of the thermostatic switch 46 are arranged at a distance with respect to each other. The boiler 1 may comprise any other suitable thermal switching means than the thermostatic switch 46, for example a thermistor with an electronic controller.

According to a preferred possibility, the thermostatic switch 46 is located close to the heating element 50, and a heat barrier is located in the heating plate 51 for directing heat from the heating element 50 to the thermostatic switch 46 rather than to a rest of the heating plate 51. In a practical embodiment, such a heat barrier may be formed as a slot in the heating plate 51.

The way in which the water level in the boiler 1 is controlled will now be explained with reference to FIG. 1. In the Figure, a water level at which the water just covers the entire bottom wall 12 is represented by a dotted line and indicated by reference sign A. When the water level is at or above this level A, the quantity of water in the boiler space 11 is sufficient for a normal operation of the boiler 1. However, when the water level has fallen below level A and the water does not cover the upper portion 12*b* of the bottom wall 12, a new supply of water is needed to avoid a situation in which the boiler 1 boils dry and the production of steam is interrupted. In FIG. 1, a water level at which water is present in the boiler space 11, but at which the water leaves the upper portion 12*b* of the bottom wall 12 uncovered is represented by a dotted line and indicated by reference sign B.

When the water level corresponds to level B, the temperature of the upper portion 12*b* of the bottom wall 12 is significantly higher than a normal temperature associated with a situation in which this portion 12*b* is covered with water. A switching temperature at which the switching component of the thermostatic switch 46 is put from an opened position to a closed position is above the normal temperature, so that the switching component remains in the opened position as long as the water level is at or above level A. When the water level drops from level A to level B, the temperature of the upper portion 12*b* of the bottom wall 12 gets higher than the normal temperature, and, at a certain moment, also gets higher than the switching temperature of the switching component. At that moment, the switching component is closed and, consequently, the pump 41 is activated.

As a result of the operation of the pump 41, water is pumped from the water tank 30 to the boiler 1, through the pump hose 42 and the water supply hose 45. The water enters the boiler space 11 through the inlet opening 15. In the boiler space 11, the water falls while following a substantially vertical imaginary path, mainly under the influence of gravity. In FIG. 1, this path is represented by a dotted line and indicated by reference sign C. Given the fact that the inlet opening 15 is arranged in the lower portion 13*a* of the top wall 13, the newly supplied water lands on the circumferential wall 14, in particular at a position of the lower zone 14*a* of the circumferential wall 14. In FIG. 1, the position where the water lands on the circumferential wall 14 is indicated by reference sign D. As soon as the water contacts the circumferential wall 14, it starts to flow along the circumferential wall 14, in a downward direction. In the process, the water is heated under the influence of contact with the circumferential wall 14. As a result, when the newly supplied water reaches the water which is already present in the boiler space 11 and gets mixed with this water, the temperature of the total quantity of water remains at a level that is sufficient for the production of steam.

Since the water is supplied in the lower region 1*a* of the boiler 1, a situation in which the temperature of the upper portion 12*b* of the bottom wall 12 is directly influenced by the flow of supplied water is avoided. Consequently, the temperature of the upper portion 12*b* of the bottom wall 12 serves as an accurate indication of the extent to which the bottom wall 12 is covered with water. As an advantageous result, premature switching of the switching component of the thermostatic switch 46 from the closed position to the opened position does not occur.

As a result of the supply of water, the water level in the boiler 1 rises, and the bottom wall 12 of the boiler housing 10 gets entirely covered with water. Under the influence of the contact with the water, the temperature of the portion 12*b* of the bottom wall 12 associated with the thermostatic switch 46 strongly decreases, which causes the switching component of the thermostatic switch 46 to switch from the closed position to the opened position, whereby the pump 41 is de-activated and the supply of water from the water tank 30 to the boiler 1 is stopped.

During operation of the steam ironing device 100 and the boiler 1, the cycle of the quantity of water reaching a minimum due to steam generation and reaching a maximum due to water supply from the water tank 30 is continually repeated, wherein it is ensured that the steam production of the boiler 1 does not get interrupted.

In an alternative embodiment of the first boiler 1, the inlet opening 15 is positioned straight above a portion of the bottom wall 12 which is associated with the heating element 50. In FIG. 1, the associated alternative configuration of an end of the water supply hose 45 and the associated alternative imaginary path which is followed by newly supplied water are indicated by dotted lines.

In this alternative embodiment, the steam performance of the boiler 1 is optimized, because newly supplied water arrives directly at the hottest zone of the boiler 1, i.e. a ring-shaped or U-shaped zone associated with the heating element 50. On the basis of this fact, it is also ensured that the steam production is not interrupted by a supply of water, even though newly supplied water is not pre-heated through contact with the circumferential wall 14.

Figure 2:
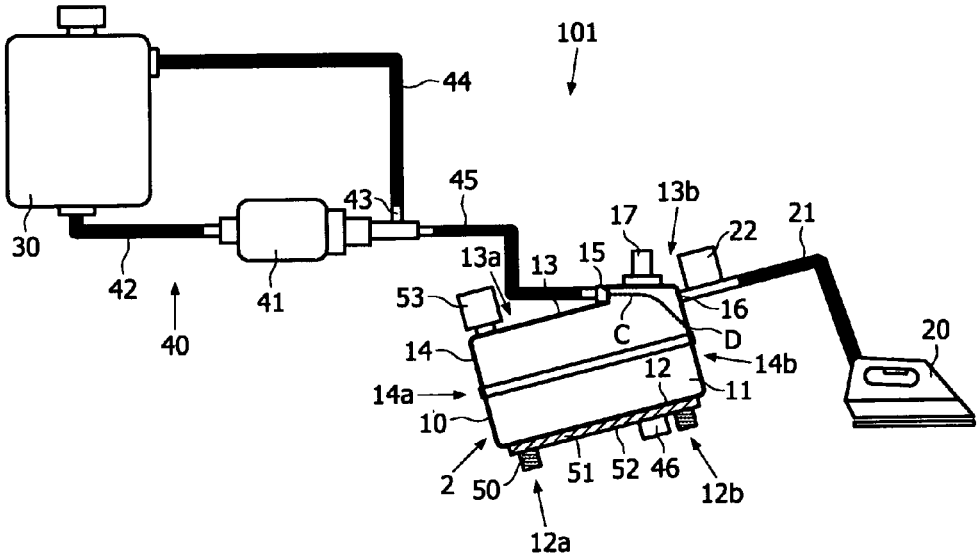

FIG. 2 diagrammatically shows a steam ironing device 101, comprising a boiler 2 according to a second preferred embodiment of the present invention, which will hereinafter also be referred to as second boiler 2.

The second boiler 2 resembles the first boiler 1 to a large extent. The only important differences relate to the position of the inlet opening 15 and the shape of the top wall 13 of the boiler housing 10.

The top wall 13 of the boiler housing 10 of the second boiler 2 comprises a sheet having two steps and a transition part in between, wherein a highest of the two steps is at the upper portion 13*b* of the top wall 13, and the inlet opening 15 is arranged in the transition part. Due to this configuration, when water is supplied to the boiler space 11, the water enters the boiler space 11 in a substantially horizontal flow. Under the influence of gravity, the flow is bent in a downward direction and ends on the circumferential wall 14, in particular at a position of the upper zone 14*b* of the circumferential wall 14. In FIG. 2, the imaginary path which is followed by newly supplied water is represented by a dotted line and indicated by reference sign C, and the position where the water lands on the circumferential wall 14 is indicated by reference sign D. After the water has landed on the upper zone 14*b* of the circumferential wall 14, it flows along the circumferential wall 14 in a downward direction.

In the second boiler 2, newly supplied water is pre-heated before it reaches the upper portion 12*b* of the bottom wall 12 of the boiler housing 10. In that way, it is achieved that a temperature drop of the upper portion 12*b* of the bottom wall 12 is limited, so that a thermo-shock effect to the heating element 50 and the heating plate 51 is reduced and that intermittent pumping occurs to a lesser extent or does not even occur at all.

Figure 3:
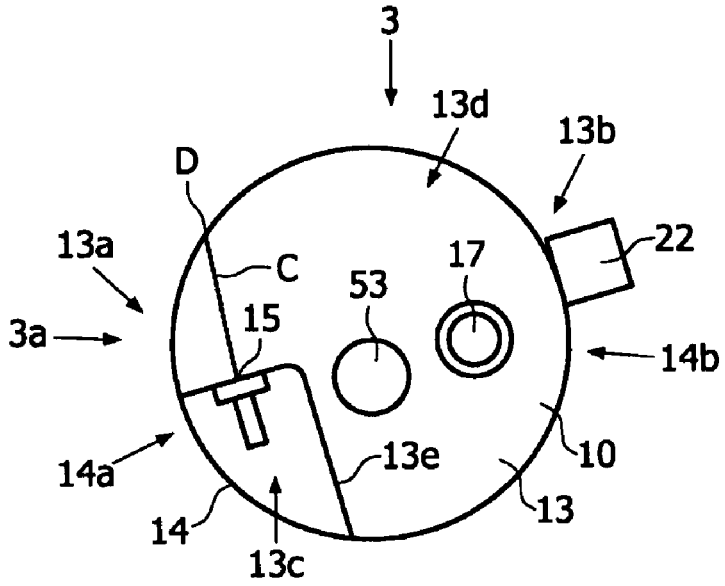
FIG. 3 is a top view of a boiler according to a third preferred embodiment of the present invention.
Figure 4:
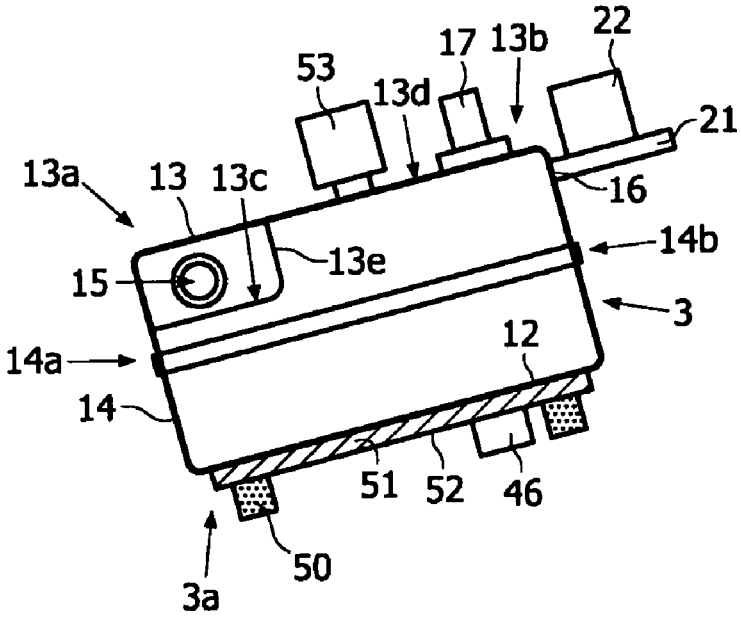
FIG. 4 is a side view of the boiler as shown in FIG. 3.

FIGS. 3 and 4 show a boiler 3 according to a third preferred embodiment of the present invention, which will hereinafter also be referred to as third boiler 3.

The third boiler 3 resembles the first boiler 1 to a large extent. The only important differences relate to the position of the inlet opening 15 and the shape of the top wall 13 of the boiler housing 10.

The top wall 13 of the boiler housing 10 of the third boiler 3 comprises a sheet having a first portion 13*c* extending at a lower level and a second portion 13*d* extending at a higher level, wherein the first portion 13*c* borders on a portion of the circumference of the sheet. The first portion 13*c* and the second portion 13*d* are connected to each other through a transition portion 13*e*, comprising two surfaces which extend substantially perpendicular to each other, as well as to outer surfaces of both the first portion 13*c* and the second portion 13*d*. The first portion 13*c* is situated at the lower portion 13*a* of the top wall 13, and the inlet opening 15 is arranged in one of the surfaces of the transition portion 13*e*, in particular a surface extending substantially perpendicular to an imaginary tilting axis about which the boiler 3 is tilted.

As a consequence of the specific position of the inlet opening 15 in the top wall 13 of the boiler housing 10, when water is supplied to the boiler space 11, the water enters the boiler space 11 in a substantially horizontal flow. Under the influence of gravity, the flow is bent in a downward direction and ends on the circumferential wall 14, in particular at a position of the lower zone 14*a* of the circumferential wall 14. In FIG. 3, the imaginary path which is followed by newly supplied water is represented by a dotted line and indicated by reference sign C, and the position where the water lands on the circumferential wall 14 is indicated by reference sign D. After the water has landed on the lower zone 14*a* of the circumferential wall 14, it flows along the circumferential wall 14 in a downward direction.

The position where a flow of newly supplied water lands on the circumferential wall 14 of the boiler housing 10 of the third boiler 3 does not differ much from the position where a flow of newly supplied water lands on the circumferential wall 14 of the boiler housing 10 of the first boiler 1. Consequently, the third boiler 3 functions in a similar manner as the first boiler 1, wherein the production of steam does not stop when a supply of water takes place, and wherein a premature termination of the supply of water is avoided.

An advantage of the shape of the top wall 13 of the third boiler 3 with the recessed first portion 13*c* is that in case a water supply hose 45 is connected to the inlet opening 15, the connection is located below the level of the second portion 13*d*, so that a compact design of the boiler 3 and a supplying arrangement 40 connected thereto is obtained.

Figure 5:
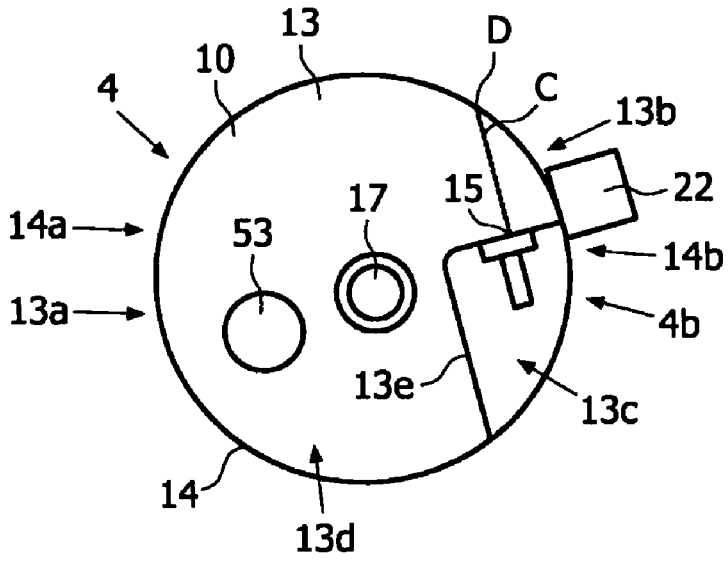
FIG. 5 is a top view of a boiler according to a fourth preferred embodiment of the present invention.
Figure 6:
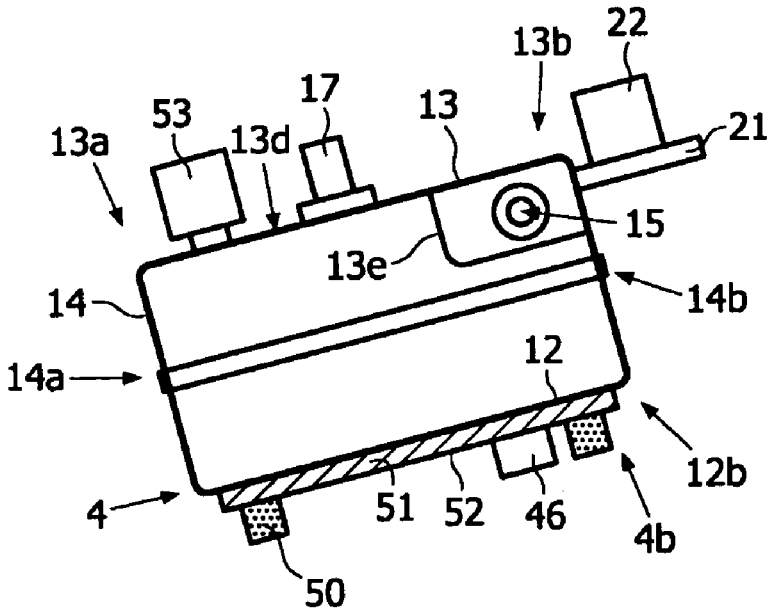
FIG. 6 is a side view of the boiler as shown in FIG. 5.

FIGS. 5 and 6 show a boiler 4 according to a fourth preferred embodiment of the present invention, which will hereinafter also be referred to as fourth boiler 4.

The fourth boiler 4 resembles the third boiler 3 to a large extent. The only important difference relates to the position of the first portion 13*c* of the top wall 13 of the boiler housing 10. In the fourth boiler 4, the first portion 13*c* is situated at the upper portion 13*b* of the top wall 13, while the inlet opening 15 is also arranged in the surface of the transition portion 13*e* which extends substantially perpendicular to an imaginary tilting axis about which the boiler 4 is tilted.

The imaginary path followed by newly supplied water in the fourth boiler 4 is comparable to the path followed by newly supplied water in the third boiler 3. In fact, the only important difference is that in the fourth boiler 4, the path is situated in an upper region 4*b* of the boiler 4, whereas in the third boiler 3, the path is situated in the lower region 3*a* of the boiler 3. Consequently, in the fourth boiler 4, a flow of newly supplied water ends on the upper zone 14*b* of the circumferential wall 14. In FIG. 5, the imaginary path which is followed by newly supplied water is represented by a dotted line and indicated by reference sign C, and the position where the water lands on the circumferential wall 14 is indicated by reference sign D. After the water has landed on the upper zone 14*b* of the circumferential wall 14, it flows along the circumferential wall 14 in a downward direction.

The position where a flow of newly supplied water lands on the circumferential wall 14 of the boiler housing 10 of the fourth boiler 4 does not differ much from the position where a flow of newly supplied water lands on the circumferential wall 14 of the boiler housing 10 of the second boiler 2. Consequently, the fourth boiler 4 functions in a similar manner as the second boiler 2, wherein newly supplied water is pre-heated before it reaches the upper portion 12*b* of the bottom wall 12 of the boiler housing 10.

It will be clear to a person skilled in the art that the scope of the present invention is not limited to the examples discussed in the foregoing, but that several amendments and modifications thereof are possible without deviating from the scope of the present invention as defined in the attached claims.

The boiler 1, 2, 3, 4 according to the present invention is suitable to be used in all kinds of devices. The application of the boiler 1, 2, 3, 4 is not at all limited to the disclosed application in a steam ironing device 100, 101.

A whole of components of the disclosed steam ironing devices 100, 101 which are associated with the boiler 1, 2, components which are arranged for supplying water to the boiler 1, 2, and components which are arranged for supplying steam to the steam iron 20, i.e. a whole of all other components of the steam ironing devices 100, 101 than the steam iron 20, is also referred to as steam generating device. The steam generating devices as shown in FIGS. 1 and 2 may be applied in combination with any appliance which is capable of making use of steam.

Within the scope of the present invention, it is important that the boiler 1, 2, 3, 4 comprises heating means for heating a content of the boiler housing 10. In principle, the design of the heating means may be chosen freely. For example, the heating plate 51 may be omitted, the heating element 50 does not necessarily need to be ring-shaped or U-shaped, and the boiler 1, 2, 3, 4 may comprise more than one heating element 50.

Components like the safety valve 17, the electro-valve 22 on the steam delivery hose 21, and the de-airing valve 43 may be replaced by other components which are capable of performing a similar function. In any case, these components are not essential to the present invention.

The bottom wall 12 and the top wall 13 of the boiler housing 10 do not necessarily need to extent substantially parallel to each other. It is preferred that the bottom wall 12 is inclined with respect to the horizontal, so that the process of controlling the water level in the boiler 1, 2, 3, 4 may be performed in a relatively simple manner, by using the thermostatic switch 46.

In view of a proper operation of the boiler 1, 2, 3, 4, an angle between the horizontal and the bottom wall 12 of the boiler housing 10 is preferably larger than 5° and smaller than 40°. It is even more preferred that the angle is between 5° and 25°, and it is most preferred that the angle is between 5° and 15°.

In the foregoing, boilers 1, 2, 3, 4 for heating water to steam are described. The boilers 1, 2, 3, 4 comprise a boiler housing 10 having a bottom wall 12, a top wall 13 and a circumferential wall 14 extending between the bottom wall 12 and the top wall 13. When the boiler 1, 2, 3, 4 is mounted in a steam generating device for generating steam and supplying steam to an appliance such as a steam iron 20, the boiler 1, 2, 3, 4 is given an inclined orientation.

For the purpose of letting in water to a boiler space 11 which is enclosed by the boiler housing 10, an inlet opening 15 is arranged in the boiler housing 10. In a boiler 1 according to a first preferred embodiment of the present invention, the inlet opening 15 is arranged in a lower portion 13*a* of the top wall 13 of the boiler housing 10. When water is supplied through the inlet opening 15, the water lands on a lower zone 14*a* of the circumferential wall 14 and flows further in a downward direction, along the circumferential wall 14. As a result, the water is pre-heated when it reaches the water which is already present in the boiler space 11, and there is no danger of the steam production getting interrupted.

The invention claimed is:

1. A boiler for heating water, comprising a boiler housing enclosing a boiler space, wherein an inlet opening for letting in water to the boiler space is arranged in the boiler housing, characterized in that the inlet opening provides access for a flow of water to a portion of a wall of the boiler housing, other than a portion of a wall situated at a bottom side of the boiler, wherein, during operation of the boiler, the first-mentioned portion of the wall of the boiler housing is involved in a process of heating water entering the boiler space before this water mixes with water which is already present in the boiler space.

2. The boiler as claimed in claim 1, wherein the boiler housing comprises a bottom wall, a top wall and a circumferential wall extending between the bottom wall and the top wall, wherein the bottom wall is situated at a bottom side of the boiler and the top wall is situated at a top side of the boiler, and wherein the inlet opening for letting in water to the boiler space is arranged for providing access for a flow of water to a portion of the circumferential wall.

3. The boiler according as claimed in claim 2, wherein the circumferential wall comprises a lower zone and a an upper zone, wherein the inlet opening for letting in water to the boiler space is arranged for providing access for a flow of water to the upper zone of the circumferential wall.

4. The boiler as claimed in claim 2, wherein the top wall of the boiler housing comprises a lower portion and an upper portion, wherein the upper portion is arranged at a higher level than the lower portion, and wherein the inlet opening is arranged in the lower portion of the top wall.

5. The boiler as claimed in claim 2, wherein the bottom wall of the boiler housing comprises a lower portion and an upper portion, and wherein the upper portion is arranged at a higher level than the lower portion.

6. The boiler as claimed in claim 1, wherein said boiler further comprises heating means for heating a content of the boiler housing, wherein the heating means are connected to an outside of the boiler housing by means of a connecting method involving melting together of materials under the influence of heat, such as brazing, soldering or welding.

7. A steam generating device, comprising:

a water tank for containing water;

a boiler as claimed in claim 1; and supplying means for supplying water from the water tank to the boiler space of the boiler, through the inlet opening arranged in the boiler housing of the boiler, comprising a pump.

8. The steam generating device as claimed in claim 7, wherein the supplying means are adapted to directing a flow of water to a portion of a wall of the boiler housing, other than a portion of a wall situated at a bottom side of the boiler, through the inlet opening.

9. The steam generating device as claimed in claim 7, wherein said steam generating device further comprises thermal switching means for controlling the pump of the supplying means, wherein the bottom wall of the boiler housing comprises a lower portion and an upper portion, wherein the upper portion is arranged at a higher level than the lower portion, and wherein the thermal switching means are arranged at an outside of the upper portion of the bottom wall.

10. A boiler for heating water, said boiler comprising a boiler housing enclosing a boiler space, and heating means for heating a content of the boiler housing, which are connected to an outside of the boiler housing by means of a connecting method involving melting together of materials under the influence of heat, such as brazing, soldering or welding, wherein the heating means comprises a heating element for generating heat, characterized in that the heating means further comprises a heating plate for distributing heat, wherein the heating plate is connected to the outside of the boiler housing by means of a connecting method involving melting together of materials under the influence of heat, such as brazing, soldering or welding, and wherein the heating element is connected to the heating plate by means of a similar connecting method.

11. The boiler as claimed in claim 10, wherein an inlet opening for letting in water to the boiler space is arranged in the boiler housing, providing access for a flow of water to a portion of the boiler housing where the heating means are externally arranged.

12. A domestic appliance, such as a steam ironing device, an active ironing board, a facial sauna device, a steam cleaning device or a coffee maker, wherein said domestic appliance comprises a boiler as claimed in claim 1.

13. The boiler as claimed in claim 10, wherein a bottom wall of the boiler housing comprises a lower portion and an upper portion, wherein the upper portion is arranged at a higher level than the lower portion.

14. A steam generating device, comprising:

a water tank for containing water;

a boiler as claimed in claim 10; and supplying means for supplying water from the water tank to the boiler space of the boiler, through an inlet opening arranged in the boiler housing of the boiler, comprising a pump.

15. The steam generating device as claimed in claim 14, wherein said steam generating device further comprises thermal switching means for controlling the pump of the supplying means, wherein a bottom wall of the boiler housing comprises a lower portion and an upper portion, wherein the upper portion is arranged at a higher level than the lower portion, and wherein the thermal switching means are arranged at an outside of the upper portion of the bottom wall.

16. The steam generating device as claimed in claim 15, wherein the heating means of the boiler comprises a heating element for generating heat and a heating plate for distributing heat, wherein the thermal switching means is located close to the heating element, and wherein a heat barrier is located in the heating plate for directing heat from the heating element to the thermal switching means rather than to a rest of the heating plate.

* * * * *